US008578662B1

(12) United States Patent
Monk

(10) Patent No.: US 8,578,662 B1
(45) Date of Patent: Nov. 12, 2013

(54) WINDOW WELL ENCLOSURE WITH ATTACHABLE STEPS

(76) Inventor: Raeanne Monk, Forest City, IA (US)

( * ) Notice: Subject to any disclaimer, the term of this patent is extended or adjusted under 35 U.S.C. 154(b) by 175 days.

(21) Appl. No.: 12/910,039

(22) Filed: Oct. 22, 2010

Related U.S. Application Data

(60) Provisional application No. 61/355,524, filed on Jun. 16, 2010.

(51) Int. Cl.
*E04F 17/06* (2006.01)

(52) U.S. Cl.
USPC ..... 52/107; 52/284; 52/184; 52/741.2

(58) Field of Classification Search
USPC ..... 52/107, 169.7, 289, 284, 238.1, 184, 52/741.2, 182, 36.4, 36.5, 36.6
See application file for complete search history.

(56) References Cited

U.S. PATENT DOCUMENTS

| | | | | |
|---|---|---|---|---|
| 4,928,465 | A * | 5/1990 | Del Castillo Von Haucke | 52/239 |
| 4,961,295 | A * | 10/1990 | Kosch et al. | 52/36.5 |
| 5,487,690 | A * | 1/1996 | Stoffle et al. | 446/105 |
| 5,706,624 | A * | 1/1998 | Lipson | 52/745.2 |
| 5,857,578 | A * | 1/1999 | Fishman | 211/189 |
| 5,941,026 | A * | 8/1999 | Eisenreich et al. | 52/36.5 |
| 6,006,480 | A * | 12/1999 | Rook | 52/309.12 |
| 6,298,631 | B1 * | 10/2001 | Finley | 52/742.15 |
| 6,484,455 | B1 * | 11/2002 | Poole | 52/107 |
| 6,854,233 | B2 * | 2/2005 | Pitsch et al. | 52/584.1 |
| D523,966 | S * | 6/2006 | Kitchen et al. | D25/47.1 |
| 7,549,256 | B1 * | 6/2009 | Watkins | 52/107 |
| 7,730,673 | B2 * | 6/2010 | George | 52/107 |
| 7,730,674 | B1 * | 6/2010 | Gernstein | 52/107 |
| 7,770,340 | B2 | 8/2010 | Heady et al. | |
| 7,823,333 | B2 * | 11/2010 | Kim | 52/36.5 |
| 2004/0098929 | A1 * | 5/2004 | Kim et al. | 52/107 |
| 2007/0039259 | A1 * | 2/2007 | MacDonald et al. | 52/238.1 |
| 2007/0079561 | A1 * | 4/2007 | Hopkins | 52/36.5 |
| 2007/0089373 | A1 * | 4/2007 | Heady et al. | 52/107 |
| 2008/0010911 | A1 * | 1/2008 | George | 52/107 |
| 2009/0090160 | A1 * | 4/2009 | Kemp | 72/379.6 |
| 2010/0175332 | A1 * | 7/2010 | Henriott | 52/36.6 |
| 2010/0205897 | A1 * | 8/2010 | George | 52/741.11 |

* cited by examiner

*Primary Examiner* — Robert Canfield
*Assistant Examiner* — Matthew Gitlin
(74) *Attorney, Agent, or Firm* — Dicke, Billig & Czaja, PLLC

(57) ABSTRACT

A window well enclosure including a front wall, a first side wall and a second side wall that engage each other. At least one step is attachable to the window well enclosure using a channel formed in at least one of the front wall, the first side wall and the second side wall.

15 Claims, 4 Drawing Sheets

WINDOW WELL ENCLOSURE WITH ATTACHABLE STEPS

REFERENCE TO RELATED APPLICATION

This application claims priority to U.S. Provisional Application No. 61/355,524, which was filed on Jun. 16, 2010, the contents of which are incorporated herein by reference.

FIELD OF THE INVENTION

The invention relates generally to window well enclosures. More particularly, the invention relates to window well enclosures having at least one step that is attachable thereto.

BACKGROUND OF THE INVENTION

In certain situations, dwellings have rooms that are located at least partially below a surface of ground that is located adjacent to an outer wall of the dwellings. Depending on factors such as the intended use of such rooms and the elevation of the ground surface adjacent to other portions of the dwelling, it may be necessary to provide the room with a manner in which persons in the room with the ability to egress from the room in emergency instances where other egress mechanisms are blocked or are otherwise unavailable.

In these situations, it is convention to provide a window or door in the room that provides an alternative means of egress from the room. Since this window or door may be located at least partially below the ground surface that is adjacent to the window or door, a recess may be formed in the ground that corresponds to the provide access to the window or door.

To prevent the ground from refilling the recess, a window well enclosure may be placed at least partially into the ground. The window well enclosure may thereby provide an open region through which a person may pass if it is needed to egress from the room through the window or door.

One such window well enclosure is a metal sheet that is bent into a semi-circular shape. The ends of the metal sheet are placed along the outer surface of the dwelling to thereby prevent the ground from passing around the metal sheet and into the recess.

It is also been proposed to use modular configurations to form the window well enclosure. One such modular window well enclosure configuration is discussed in Heady et al., U.S. Pat. No. 7,770,340. Heady indicates that elongated segments may be used to form the front and side walls of the window well enclosure. The elongated segments join together to form the window well enclosure. Depending on the desired height of the window well enclosure, multiple rows of elongated segments may be placed on top of each other.

SUMMARY OF THE INVENTION

An embodiment of the invention is directed to a window well enclosure that includes a front wall, a first side wall, a second side wall, a first edge attachment mechanism, a second edge attachment mechanism, a first corner attachment mechanism and a second corner attachment mechanism.

The front wall has a first edge and a second edge. The first side wall has a first edge and a second edge. The second side wall has a first edge and a second edge. The first edge attachment mechanism has a first recess formed therein that is adapted to receive the first edge of the first side wall. The second edge attachment mechanism has a first recess formed therein that is adapted to receive the first end of the second side wall.

The first corner attachment mechanism has a first recess and a second recess formed therein. The first recess is adapted to receive the first edge of the front wall. The second recess is adapted to receive the second edge of the first side wall. The second corner attachment mechanism has a first recess and a second recess formed therein. The first recess is adapted to receive the second edge of the front wall. The second recess is adapted to receive the second edge of the second side wall.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE PREFERRED EMBODIMENTS

Figure 1:
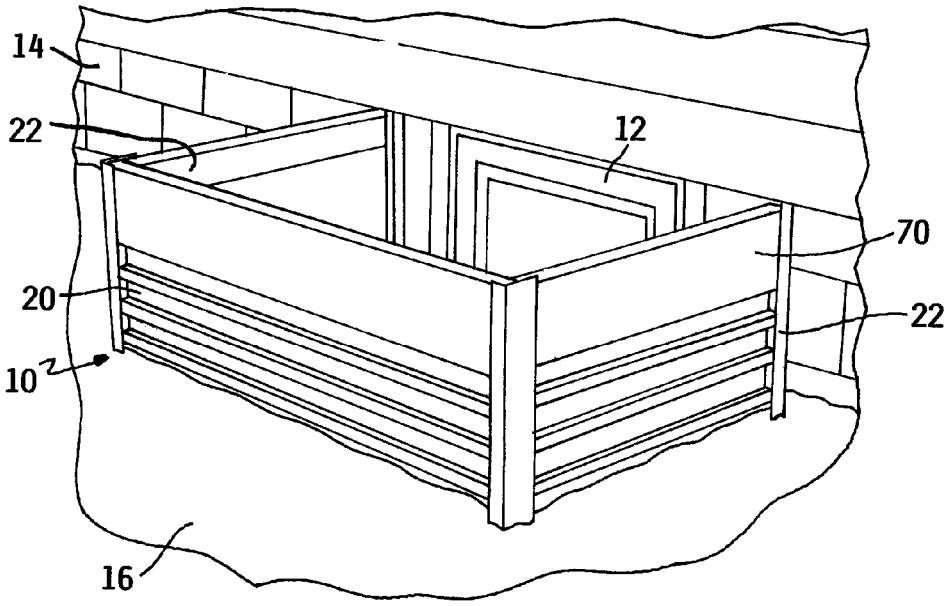
FIG. 1 is an outside perspective view of a window well enclosure according to an embodiment of the invention.
Figure 2:
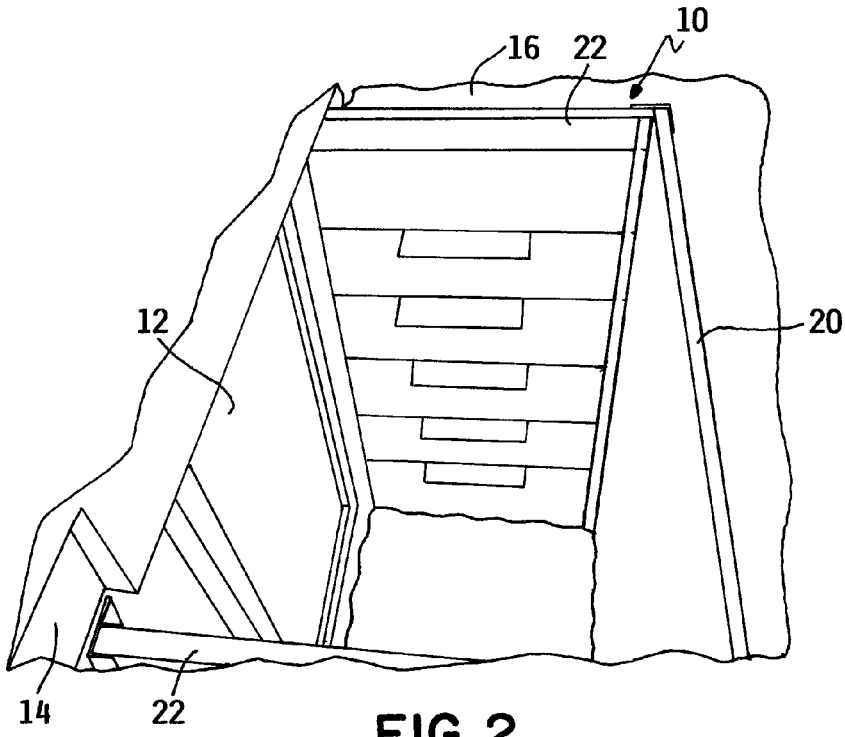
FIG. 2 is an inside perspective view of the window well enclosure.

An embodiment of the invention is directed to a window well enclosure, as illustrated at 10 in the figures. The window well enclosure 10 may be installed adjacent to a window or door 12 in a dwelling or other structure 14 where at least a portion of the window 12 is located beneath an upper surface of ground 16 that is adjacent to the window 12, as illustrated in FIGS. 1 and 2.

The window well enclosure 10 thereby holds back the ground 16 and prevents the ground 16 from entering a recess that is defined between the window well enclosure 10 and the window 12.

Figure 3:
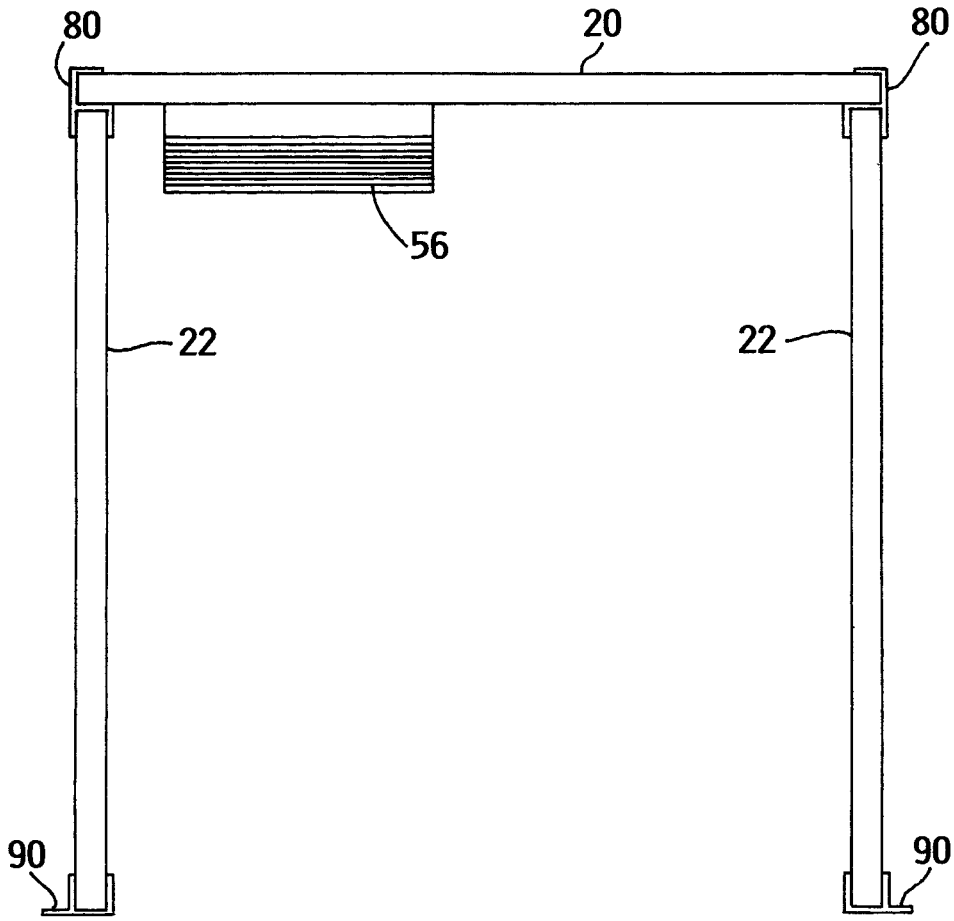
FIG. 3 is a top view of the window well enclosure.

The window well enclosure 10 is generally defined by a front panel 20 and a pair of side panels 22, as illustrated in FIG. 3. The side panels 22 are mounted proximate opposite ends of the front panel 20 and extend between the front panel 20 and the dwelling 14.

The front panel 20 may be formed with a length that is slightly larger than the width of the window 12. In certain embodiments, the front panel 20 may be formed with a length that is significantly greater than a width of the window 12 to provide sufficient space for a person to fit within the recess defined by the window well enclosure 10. In certain embodiments, the front panel 20 may have a width of between about 2 feet and about 6 feet.

The front panel 20 may be formed with a height that is sufficiently long so that the front panel 20 extends from below a lower edge of the window 12 to above the ground surface 16. In certain embodiments, the front panel 20 may have a height of between about 2 feet and 6 feet.

Figure 4:
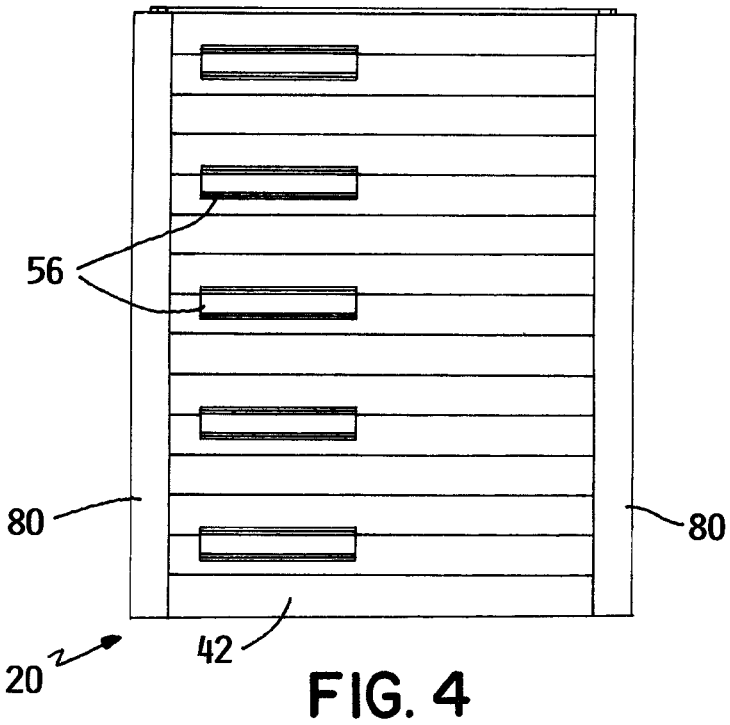
FIG. 4 is an inner view of a front panel for the window well enclosure.

In certain embodiments, the front panel 20 may be formed with a modular configuration where a plurality of panel sections 40 are placed on top of each other to provide the front panel 20 with a desired height, as illustrated in FIG. 4.

The side panel 22 may be formed with a length that provides sufficient spacing between the front panel 20 and the dwelling 14 to provide sufficient space for a person to fit within the recess defined by the window well enclosure 10. In certain embodiments, the side panel 22 may have a length of between about 2 feet and 6 feet.

The side panel 22 may be formed with a height that is approximately the same as a height of the front panel 20. As noted above, the side panel 22 may be formed with a height that is sufficiently long so that the side panel 22 extends from below a lower end of the window 12 to above the ground surface 16. In certain embodiments, the side panel 22 may have a height of between about 2 feet and 6 feet.

Figure 5:
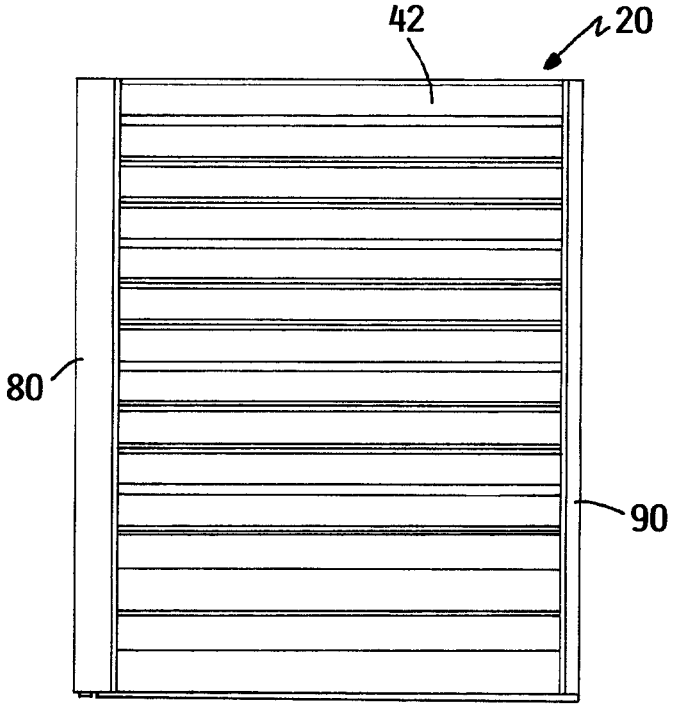
FIG. 5 is an outer view of a side panel for the window well enclosure.

In certain embodiments, the side panel 22 may be formed with a modular configuration where a plurality of panel sections 42 are placed on top of each other to provide the side panel 22 with a desired height, as illustrated in FIG. 5. The panel sections 42 used to fabricate the side panel 22 may have a profile that is substantially similar to a profile of the panel section 40 that are used to fabricate the front panel 20.

The panel sections 42 have an upper end 44 and a lower end 46 proximate opposite ends thereof. The upper end 44 and the lower end 46 may be shaped substantially complementary to each other to facilitate forming a substantially continuous surface when multiple panel sections 42 are placed in a stacked configuration where the upper end 44 on a first panel section 42 is adjacent to a lower end of a second panel section, as illustrated in FIGS. 4 and 5.

While it is possible for the upper end 44 and the lower end 46 to be substantially flat, in certain embodiments, the upper end 44 has a convex shape and the lower end 46 has a concave shape, which is substantially complementary to the convex shape of the upper end 44.

The shape of the upper end 44 and the lower end 46 may be non-symmetrical to restrict the ability of the adjacent panel sections 42 to only be stacked in a particular direction in a similar orientation.

To increase a strength of the panel section 42, the upper end 44 and the lower end 46 may both be part of a support extension 47*a*, 47*b* that extends from a back surface of the main body 48 of the panel section 42. The upper and lower support extension 47*a*, 47*b* thereby reduces the potential of the panel section 42 bending or twisting in response to forces placed thereon.

The main body 48, the upper support extension 47*a* and the lower support extension 47*b* thereby define a partially enclosed region in the panel section 42. The main body 48 is along a front surface of the panel section 42. Ends of the upper support extension 47*a* and the lower support extension 47*b* opposite the main body 48 define a back surface of the panel section 42.

Figure 6:
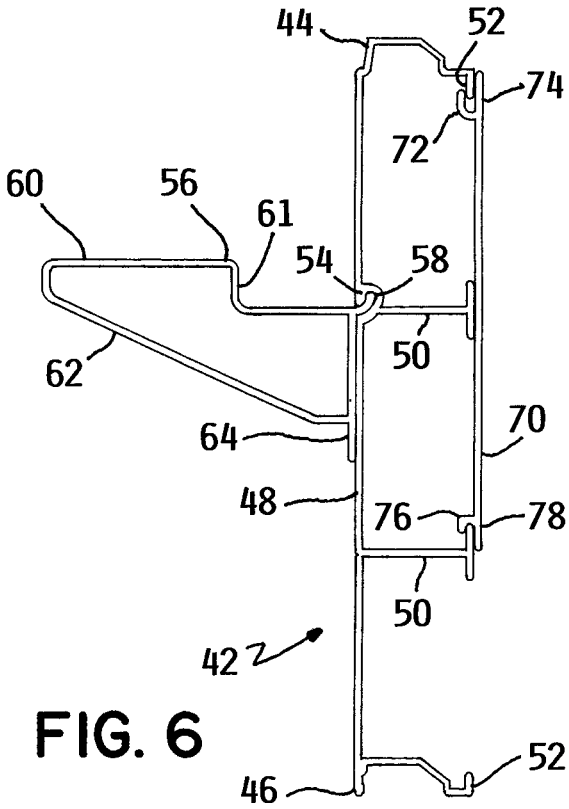
FIG. 6 is a sectional view of the panel section for use in fabricating the front panel.

The upper support extension 47*a* may have a convex shape and the lower support extension 47*b* may have a concave shape, as illustrated in FIG. 6. The upper support extension 47*a* may have a shape that is complementary to a shape of the lower support extension 47*b*. Providing the upper support extension 47*a* with a shape that is complementary to the shape of the lower support extension 47*b* enhances a surface area over which the upper support extension 47*a* engages the lower support extension 47*b* when the panel sections 42 are placed in a vertically stacked configuration, as illustrated in FIGS. 1, 2, 4 and 5.

The upper support extension 47*a* and the lower support extension 47*b* thereby retain adjacent panel sections 42 in the vertically stacked configuration even when fill such as dirt is placed around an outside of the window well enclosure 10 such as illustrated in FIG. 1. The complementary convex and concave shape of the upper support extension 47*a* and the lower support extension 47*b* also enables the window well enclosure 10 to resist fill such as dirt that is placed around an outside of the window well enclosure 10 from passing between the panel sections 42. The complementary convex and concave shape of the upper support extension 47*a* and the lower support extension 47*b* also enhances the ability to accurately align panel sections during the stacking process of forming the wall.

The upper support extension 47*a* includes a central support region 51 that is oriented transverse to the main body 48. Extending between the main body 48 and the central support region 51 is a first interconnecting support section 53. The first interconnecting support section 53 may not be linearly aligned with the main body 48 and the central support region 51. Extending between the central support region 51 and the upper tab 52*a* is an interconnecting support section 55. The second interconnecting support section 55 may not be linearly aligned with the central support region 51 and the upper tab 52*a*.

The lower support extension 47*b* includes a central support region 61 that is oriented transverse to the main body 48. Extending between the main body 48 and the central support region 61 is a first interconnecting support section 63. The first interconnecting support section 63 may not be linearly aligned with the main body 48 and the central support region 61. Extending between the central support region 61 and the lower tab 52*b* is an interconnecting support section 65. The second interconnecting support section 65 may not be linearly aligned with the central support region 61 and the lower tab 52*b*.

Each of the extensions may include a tab 52 extending therefrom. The tab 52 may be used for attaching components such as a decorative panel to the panel section 42 as is discussed in more detail below.

To further increase the strength of the panel section 42, at least one intermediate rib 50 may be placed thereon. The at least one intermediate rib 50 may extend from the back surface of the main body 48. The at least one intermediate rib 50 may have a generally T-shaped profile.

The panel section 42 may have at least one channel 54 formed therein that is used for attaching an object such as a step 56 to the panel section 42. As illustrated in FIG. 6, the channel 54 may have a non-linear shape. In certain embodiments, the channel 54 has an arcuate configuration.

The channel 54 should be configured to resist the disengagement of the step 56 from the panel section 42 when a force is placed thereon such as happens when a person stands on the step 56. Forming the channel 54 in this configuration enables the step 56 to be attached to the panel section 42 to orienting the step 56 at an angle that allows a tab 58 on the step to initially extend into the channel 54. As the step 56 is pivoted downwardly to a generally horizontal orientation, the tab 58 extends further into the channel 54 to thereby retain the step 56 in a stationary position with respect to the panel section 42.

The spacing between the channel 54 may depend on a variety of factors such as the height of the panel section 42. In certain embodiments, the channels 54 are oriented at a spacing of between about 4 inches and about 12 inches. Configuring the channels 54 with this type of spacing enables the steps 56 to be mounted sufficiently close together so that the steps may be readily used by youth and adults.

A fastener guideline may be provided proximate a lower edge of the panel section 42 to assist with aligning the fastener so that the fastener is able to extend through the lower edge of the upper panel section and an upper edge of the lower panel sections when the panel sections are placed in stacked configuration to thereby join together the panel sections 42.

To facilitate using the panel sections 42 in fabricating window well enclosures 10 having a variety of lengths, widths and heights, the panel sections 42 may be formed with a substantially consistent profile along a length of the panel section 42. One such suitable technique for fabricating the panel section 42 with a consistent profile along a length thereof is extrusion.

The panel section 42 may be fabricated from a variety of materials using the concepts of the invention. Examples of two such suitable materials that may be used to fabricate the panel section are plastic and metallic materials such as aluminum. The preceding materials are readily adapted for use in conjunction with the extrusion process referenced in the preceding paragraph.

In addition to the tab 58 that is discussed above, the step 56 may include a generally flat stepping surface 60 that extends over at least a portion of a top surface thereof. The stepping surface 60 should have a width and a length that enables both youths and adults to step safely thereon. In certain embodiments, the stepping surface 60 has a length of between about 6 inches and about 12 inches and a width of between about 2 inches and about 6 inches. The step 56 may be formed with a length that is less than a width of the side panel 22, as illustrated in FIG. 2.

The step 56 may be formed with a location on which a person may grasp with his or her hand. In certain embodiments, a recess 61 may be formed between the stepping surface 60 and the wall. The recess 61 may have a length and a depth that facilitates the person holding onto the step to assist the person in walking up a series of steps.

It is possible to use the step 56 for other purposes when the window well enclosure 10 is not utilized as an escape route. For example, the step 56 may be used as a support for planters or other decorative objects.

To further enhance the ability of a person to safely use the step 56, the stepping surface 60 may include a texture. Alternatively or additionally, the stepping surface 60 may be at least partially coated with a slip resistant material.

To provide the step 56 with sufficient rigidity to resist bending or deformation in response to a person stepping thereon, the step 56 may also include a lower support surface 62 that intersects the stepping surface distal the tab 58. At least a portion of the lower support surface 62 may be oriented at an angle, as illustrated in FIG. 6.

The step 56 may include a wall engaging surface 64. The wall engaging surface 64 should be sufficiently long to spread forces generated by a person standing on the step 56 so that the step 56 remains in a generally horizontal orientation while the person is standing on the step 56 and so that the main body 48 resists deformation caused by the wall engaging surface 64 bearing thereon. In certain embodiments, the wall engaging surface 64 may extend below the lower support surface 62.

A fastener may be extended through the wall engaging surface 64 and into the panel section 42 to retain the step 56 in a stationary portion with respect to the panel section 42. Alternatively or additionally, an adhesive may be used to retain the step in a fixed position with respect to the panel section 42.

A decorative panel 70 may be attached to a back side of the panel sections 42 that are positioned above the ground surface 16, as illustrated in FIGS. 1 and 6. The decorative panel 70 may not only enhance the aesthetic appearance of the window well enclosure 10 but may also enhance the strength of the window well enclosure 10.

In certain embodiments, the decorative panel 70 has an elongated shape with a height that is less than a height of the panel section 42. As illustrated in FIG. 6, the decorative panel 70 may extend from an upper edge of the panel section 42 to the intermediate extension 50. In other embodiments, the decorative panel 70 may have a height that is approximately the same as a height of the panel section 42.

Proximate an upper edge of the decorative panel 70, an upper connection mechanism 72 may be provided. The upper connection mechanism 72 has an upper recess 74 formed therein that is adapted to receive the tab 52 on the upper extension.

Proximate a lower edge of the decorative panel 70, a lower connection mechanism 76 may be provided. The lower connection mechanism 76 has a recess 78 formed therein that is adapted to receive the tab 52 on the lower extension.

Positioning the tab 52 on the upper extension in the upper recess 74 and positioning the tab 52 on the lower extension in the lower recess 78 enables the decorative panel 70 to be attached to the panel section 42.

In certain embodiments, the decorative panel 70 may be slid with respect to the panel section 42 to move the decorative panel 70 into engagement with the panel section 42. In other embodiments, the decorative panel 70 may be deflected to a bowed shape to attach the decorative panel 70 to the panel section 42.

As an alternative to using the connection mechanism discussed above to attach the decorative panel 70 to the panel section 42, it is possible to use other techniques. Examples of other suitable connection techniques include fasteners such as screws or adhesives.

An outer surface of the decorative panel 70 may be formed with an appearance that is similar to an appearance of other portions of the dwelling 14 on which the window well enclosure 10 is used. For example, the outer surface of the decorative panel 70 may have an appearance that is similar to siding on the dwelling. It is also possible for the outer surface of the decorative panel 70 to have an appearance that is similar to conventional brick or landscape blocks.

To facilitate using the decorative panel 70 in conjunction with window well enclosures 10 having a variety of lengths and widths, the decorative panel 70 may be formed with a substantially consistent profile along a length of the decorative panel 70. One such suitable technique for fabricating the decorative panel 70 with a consistent profile along a length thereof is extrusion.

Similar to the panel section 42, the decorative panel 70 may be fabricated from a variety of materials using the concepts of the invention. Examples of two such suitable materials that may be used to fabricate the decorative panel 70 are plastic and metallic materials such as aluminum. The preceding materials are readily adapted for use in conjunction with the extrusion process referenced in the preceding paragraph.

While it is possible to fabricate the decorative panel 70 as an integral part of the panel section 42, such a configuration would increase a cost to fabricate the panel section 42 as well as increase the weight of the panel section 42.

Figure 7:
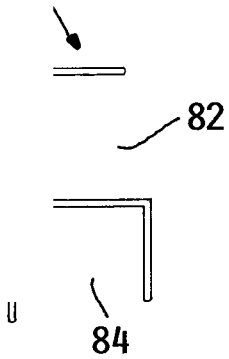
FIG. 7 is a top view of a corner attachment mechanism for use in fabricating the window well enclosure.

A corner attachment mechanism 80 may be used to attach an end of the front panel 20 to an end of the side panel 22, as illustrated in FIGS. 1 and 2. The corner attachment mechanism 80 may a first recess 82 and a second recess 84 formed therein, as illustrated in FIG. 7.

The first recess 82 may have a width that is approximately the same as a thickness of the front panel 20. The depth of the first recess 82 should be sufficiently large to minimize the potential of the front panel 20 becoming dislodged from the first recess 82. In certain embodiments, the first recess 82 may be formed with a depth that is approximately equal to the width of the first recess 82.

The second recess 84 may have a width that is approximately the same as a thickness of the side panel 22. The depth of the second recess 84 should be sufficiently large to minimize the potential of the side panel 22 becoming dislodged from the second recess 84. In certain embodiments, the second recess 84 may be formed with a depth that is approximately equal to the width of the second recess 84.

To facilitate using the corner attachment mechanism 80 in conjunction with window well enclosures 10 having a variety of heights, the corner attachment mechanism 80 may be formed with a substantially consistent profile along a length of the corner attachment mechanism 80. One such suitable technique for fabricating the corner attachment mechanism 80 with a consistent profile along a length thereof is extrusion.

Similar to the panel section 42, the corner attachment mechanism 80 may be fabricated from a variety of materials using the concepts of the invention. Examples of two such suitable materials that may be used to fabricate the corner attachment mechanism 80 are plastic and metallic materials such as aluminum. The preceding materials are readily adapted for use in conjunction with the extrusion process referenced in the preceding paragraph.

An edge attachment mechanism 90 may be used to attach an end of the side panel 22 to the dwelling 16, as illustrated in FIGS. 1 and 2. The edge attachment mechanism 90 may have a first recess 92 formed therein, as illustrated in FIG. 8.

The first recess 92 may have a width that is approximately the same as a thickness of the side panel 22. The depth of the first recess 92 should be sufficiently large to minimize the potential of the side panel 22 becoming dislodged from the first recess 92. In certain embodiments, the first recess 92 may be formed with a depth that is approximately equal to the width of the first recess 92.

Figure 8:
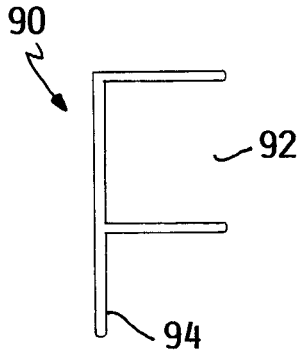
FIG. 8 is a top view of an edge attachment mechanism for use in fabricating the window well enclosure.

The edge attachment mechanism 90 may also have a leg 94 extending therefrom, as illustrated in FIG. 8. The leg 94 may be utilized for attaching the edge attachment mechanism 90 to the dwelling 16. Alternatively, a fastening mechanism used to attach the edge attachment mechanism 90 to the dwelling 16 may be extended through the edge attachment mechanism 90 in the first recess.

To facilitate using the edge attachment mechanism 90 in conjunction with window well enclosures 10 having a variety of heights, the edge attachment mechanism 90 may be formed with a substantially consistent profile along a length of the edge attachment mechanism 90. One such suitable technique for fabricating the edge attachment mechanism 90 with a consistent profile along a length thereof is extrusion.

Similar to the panel section 42, the edge attachment mechanism 90 may be fabricated from a variety of materials using the concepts of the invention. Examples of two such suitable materials that may be used to fabricate the edge attachment mechanism 90 are plastic and metallic materials such as aluminum. The preceding materials are readily adapted for use in conjunction with the extrusion process referenced in the preceding paragraph.

In operation, a hole is formed in the ground surface 16 proximate to the portion of the dwelling 14 where the window is located. The hole should have a length, width and height that are greater than the length, width and height of the window well enclosure 10 that is desired to be placed therein.

Next, the edge attachment mechanisms 90 are oriented in a generally vertical orientation and attached to the dwelling in a spaced-apart configuration that is approximately the same as a desired width of the window well enclosure 10.

The corner attachment mechanisms 80 are positioned opposite the edge attachment mechanisms 90 to provide a shape that generally conforms to a desired shape of the window well enclosure 10.

After the panel sections 42 for the side walls 22 are cut to a desired length, the panel sections 42 are stacked upon each other to form the side wall 22. In certain embodiments, fasteners such as screws may be used to attach the panel sections 42 together and/or to attach the panel sections 42 to the edge attachment mechanism 90 and the corner attachment mechanism 80.

Similarly, the panel sections 42 are cut to desired length for the front wall 20 and then stacked upon each other to form the front wall 20. In certain embodiments, fasteners such as screws may be used to attach the panel sections 42 together and/or to attach the panel sections 42 to the corner attachment mechanisms 80.

It is also possible to use a sealant between the rows of panel sections 42 used for fabricating the front wall 20 and the side walls 22 to stop water, dirt and other materials from passing between the panel sections 42 and into the interior of the window well enclosure 10. The sealant may be in a liquid form when applied or may be provided in a resilient strip. The sealant may also be provided where the panel sections 42 engage the edge attachment mechanism 90 and the corner attachment mechanism 80.

At least one step 56 is then attached to at least one of the front wall 20 and the side walls 22. In certain embodiments, the steps 56 are attached to only one of the front wall 20 and the side walls 22.

The steps 56 are oriented at an angle so that the tab 58 at least partially extends into the channel 54. The steps 56 are then pivoted to a generally horizontal orientation to cause the tab 58 to further extend into the channel 54 and retain the steps 56 in a stationary position on the wall to which the step 56 is attached.

If the front wall 20 and the side walls 22 extend sufficiently above the ground surface 16, it is possible to cut decorative panels 70 to lengths that are approximately the same as the front wall 20 and the side walls 22 and then attach the decorative panels 70 to the front wall 20 and the side walls 22.

Caps (not shown) may also be placed over the upper ends of the edge attachment mechanism 90 and the corner attachment mechanism 80 to enhance the aesthetics of the window well enclosure 10.

While the figures illustrate that the window well enclosure 10 has a generally rectangular configuration, it is possible to fabricate the window well enclosure 10 having other configurations. One such possible other configuration is trapezoidal where a width of the window well enclosure 10 is greater proximate the dwelling than a width of the window well enclosure 10 distal the dwelling. In such configurations, the edge attachment mechanism 90 and the corner attachment mechanism 80 may have to be configured to conform to the desired angles at which the front wall 20 and/or the side walls 22 are oriented.

In the preceding detailed description, reference is made to the accompanying drawings, which form a part hereof, and in which is shown by way of illustration specific embodiments in which the invention may be practiced. In this regard, directional terminology, such as "top," "bottom," "front," "back,"

"leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A window well enclosure comprising:

a front wall having a first side edge and a second side edge;

a first side wall attached to the first side edge of the front wall;

a second side wall attached to the second side edge of the front wall, wherein the front wall, the first side wall and the second side wall form an enclosure, wherein at least one of the front wall, the first side wall and the second side wall have a channel formed therein, wherein the front wall, the first side wall and the second side wall each comprises a plurality of panel sections and wherein each of the panel sections comprises:

a main body that extends between an upper edge and a lower edge of the panel section, wherein the main body has said channel formed therein;

an upper support extension that extends from the upper edge of the main body, wherein the upper support extension is oriented generally transverse to the main body and wherein the upper support extension comprises a convex portion; and a lower support extension that extends from the lower edge of the main body, wherein the lower support extension is oriented generally transverse to the main body and wherein the lower support extension comprises a concave portion and wherein the convex portion is shaped complementary to the concave portion; and a step having a tab extending therefrom, wherein at least a portion of the tab extends into the channel to attach the step to the at least one of the front wall, the first side wall and the second side wall having the channel formed therein.

2. The window well enclosure of claim 1, wherein the step comprises a stepping surface and a gripping surface.

3. The window well enclosure of claim 1, wherein the front wall and the first side wall are attached together using a first corner attachment mechanism and wherein the front wall and the second side wall are attached together using a second corner attachment mechanism.

4. The window well enclosure of claim 3, wherein the first corner attachment mechanism has a first recess and a second recess formed therein, wherein the first recess is adapted to receive the first side edge of the front wall, wherein the second recess is adapted to receive a first side edge of the first side wall, wherein the second corner attachment mechanism has a third recess and a fourth recess formed therein, wherein the third recess is adapted to receive the second side edge of the front wall and wherein the fourth recess is adapted to receive a first side edge of the second side wall.

5. The window well enclosure of claim 1, and further comprising at least one decorative panel that is attached to an outer surface of at least one of the front wall, the first side wall and the second side wall.

6. The window well enclosure of claim 5, wherein each panel section has a front surface and a back surface, wherein the front surface extends between an upper end and a lower end thereof, wherein the back surface has an opening formed therein, wherein proximate upper and lower ends of the opening, the back surface has a tab extending therefrom and wherein the upper tab and the lower tab are oriented towards each other; and wherein the window well enclosure further comprises a decorative panel having a recess formed therein proximate upper and lower ends thereof, wherein the decorative panel is adapted to attachment to the front wall by extending the upper tab into the upper recess and extending the lower tab into the lower recess.

7. A window well enclosure comprising:

a front wall having a first side edge and a second side edge;

a first side wall having a first side edge and a second side edge;

a second side wall having a first side edge and a second side edge, wherein the front wall, the first side wall and the second side wall each comprise at least two panel sections, wherein each of the panel sections has a substantially similar profile with an upper edge and a lower edge, wherein the upper edge has a shape that is complementary to a shape of the lower edge, wherein each panel section has a front side and a back side, wherein the front side extends between an upper end and a lower end thereof, wherein the back side has an opening formed therein, wherein proximate upper and lower ends of the opening, the back side has a tab extending therefrom and wherein the upper tab and the lower tab are oriented towards each other;

a first side edge attachment mechanism having a first recess formed therein that is adapted to receive the first side edge of the first side wall;

a second side edge attachment mechanism having a first recess formed therein that is adapted to receive the first side edge of the second side wall;

a first corner attachment mechanism having a first recess and a second recess formed therein, wherein the first recess of the first corner attachment mechanism is adapted to receive the first side edge of the front wall and wherein the second recess of the first corner attachment mechanism is adapted to receive the second side edge of the first side wall;

a second corner attachment mechanism having a first recess and a second recess formed therein, wherein the first recess of the second corner attachment mechanism is adapted to receive the second side edge of the front wall and wherein the second recess of the second corner attachment mechanism is adapted to receive the second side edge of the second side wall; and a decorative panel having a recess formed therein proximate upper and lower ends thereof, wherein the decorative panel is adapted to attachment to the front wall by extending the upper tab into the upper recess and extending the lower tab into the lower recess.

8. The window well enclosure of claim 7, wherein the upper edge has a convex shape and the lower edge has a concave shape.

9. The window well enclosure of claim 7, and further comprising at least one intermediate rib extending from a surface of each of the panel sections.

10. The window well enclosure of claim 7, and further comprising a fastener guideline formed in a surface of each of the panel sections.

11. The window well enclosure of claim 7, wherein at least one of the front panel, the first side panel and the second side panel includes a channel formed therein, wherein the window well enclosure further comprises at least one step having a tab extending therefrom and wherein at least a portion of the tab is received within the channel to attach the step to the at least one of the front panel, the first side panel and the second panel having the channel formed therein.

12. The window well enclosure of claim 11, wherein the step comprises a stepping surface and a gripping surface.

13. A method of forming a window well enclosure, wherein the method comprises:

forming a front wall, a first side wall and a second side wall by stacking plurality of panel sections, wherein each of the panel sections comprises:

a main body panel that extends between an upper edge and a lower edge of the panel section, wherein the main body portion has a channel formed therein;

an upper engagement region that extends from the upper edge of the main body panel, wherein the upper engagement region is oriented generally transverse to the main body panel and wherein the upper engagement region comprises a convex portion; and a lower engagement region that extends from the lower edge of the main body panel, wherein the upper engagement region is oriented generally transverse to the main body panel and wherein the lower engagement region comprises a concave portion and wherein the convex portion is shaped complementary to the concave portion;

attaching the first side wall to a first side edge of the front wall;

attaching the second side wall to a second side edge of the front wall, wherein the front wall, the first side wall and the second side wall form an enclosure, wherein at least one of the front wall, the first side wall and the second side wall have a channel formed therein; and attaching a step to the at least one of the front wall, the first side wall and the second side wall having the channel formed therein by extending at least a portion of a tab on the step into the channel.

14. The method of claim 13, wherein attaching the step comprises rotating the step to a rotated orientation, extending at least the portion of the tab into the channel and rotating the step from the rotated orientation.

15. The method of claim 13, and further comprising forming the step with a stepping surface and a gripping surface.

* * * * *